US008348406B2

(12) United States Patent
Park

(10) Patent No.: US 8,348,406 B2
(45) Date of Patent: Jan. 8, 2013

(54) LIQUID INK DELIVERY SYSTEM INCLUDING A FLOW RESTRICTOR THAT RESISTS AIR BUBBLE FORMATION IN A LIQUID INK RESERVOIR

(75) Inventor: Daniel Clark Park, West Linn, OR (US)

(73) Assignee: Xerox Corporation, Norwalk, CT (US)

( * ) Notice: Subject to any disclaimer, the term of this patent is extended or adjusted under 35 U.S.C. 154(b) by 304 days.

(21) Appl. No.: 12/847,829

(22) Filed: Jul. 30, 2010

(65) Prior Publication Data

US 2012/0026255 A1 Feb. 2, 2012

(51) Int. Cl.
*B41J 2/18* (2006.01)
*B41J 2/19* (2006.01)

(52) U.S. Cl. ..... 347/89; 347/92

(58) Field of Classification Search ..... 347/89, 347/92

See application file for complete search history.

(56) References Cited

U.S. PATENT DOCUMENTS

| | | | |
|---|---|---|---|
| 4,256,470 | A | 3/1981 | Zajicek et al. |
| 4,314,264 | A | 2/1982 | Bok et al. |
| 4,336,037 | A | 6/1982 | Goldis et al. |
| 4,792,292 | A | 12/1988 | Gaenzle |
| 5,296,875 | A | 3/1994 | Suda |
| 6,139,136 | A | 10/2000 | Mackay et al. |
| 6,193,363 | B1 | 2/2001 | Kelly |
| 6,196,668 | B1 | 3/2001 | Bode |
| 6,296,353 | B1 | 10/2001 | Thielman et al. |
| 6,302,516 | B1 | 10/2001 | Brooks et al. |
| 6,454,835 | B1 | 9/2002 | Baumer |
| 6,517,189 | B2 | 2/2003 | Ogawa et al. |
| 6,578,948 | B2 | 6/2003 | Shima |
| 6,698,870 | B2 | 3/2004 | Gunther |
| 6,799,842 | B2 | 10/2004 | Barinaga et al. |
| 6,955,423 | B2 | 10/2005 | Rodriquez Mojica et al. |
| 6,997,972 | B2 | 2/2006 | Tseng |
| 7,104,637 | B1 | 9/2006 | Van Steenkiste |
| 7,150,519 | B2 | 12/2006 | Kono et al. |
| 7,449,051 | B2 | 11/2008 | Olsen |
| 7,597,430 | B2 | 10/2009 | Umeda |
| 7,611,568 | B2 | 11/2009 | Kang et al. |
| 7,621,982 | B2 | 11/2009 | Kang et al. |
| 7,625,080 | B2 | 12/2009 | Hess et al. |
| 2003/0067518 | A1 | 4/2003 | Ishinaga et al. |
| 2005/0146582 | A1 | 7/2005 | Platt et al. |
| 2005/0151798 | A1 | 7/2005 | Merz et al. |
| 2006/0152558 | A1 | 7/2006 | Hoisington |
| 2007/0081043 | A1 | 4/2007 | Silverbrook |
| 2008/0007601 | A1 | 1/2008 | Tsai et al. |
| 2008/0122901 | A1 | 5/2008 | Platt et al. |

(Continued)

FOREIGN PATENT DOCUMENTS

JP 06126983 A * 5/1994

*Primary Examiner* — Shelby Fidler

(74) *Attorney, Agent, or Firm* — Maginot, Moore & Beck, LLP

(57) ABSTRACT

A fluid ink delivery system includes a receptacle positioned proximate to a plurality of inkjet ejectors, and an ink supply in fluid communication with the receptacle. Ink held in the receptacle may be withdrawn under negative pressure by a pump in the ink supply. A flow restrictor in fluid communication with the pump limits the negative pressure level applied by the pump to be less than a pressure that draws air across a porous member in the receptacle.

14 Claims, 5 Drawing Sheets

U.S. PATENT DOCUMENTS

2008/0273071 A1 11/2008 Brown et al.
2008/0297577 A1 12/2008 Wouters et al.
2009/0322831 A1 12/2009 Emerton et al.
2010/0026739 A1* 2/2010 Hirashima ..... 347/6
2010/0097417 A1 4/2010 Hill

* cited by examiner

LIQUID INK DELIVERY SYSTEM INCLUDING A FLOW RESTRICTOR THAT RESISTS AIR BUBBLE FORMATION IN A LIQUID INK RESERVOIR

TECHNICAL FIELD

This disclosure relates generally to machines that pump fluid to and from a reservoir, and more particularly, to a printer configured to pump liquid ink from a receptacle of an inkjet printing apparatus and supply ink to an ink reservoir in the inkjet printing apparatus.

BACKGROUND

Fluid transport systems are well known and used in a number of applications. One specific application of transporting a fluid in a machine is the transportation of ink in a printer. Common examples of inks include aqueous inks and phase change or solid inks. Aqueous inks remain in a liquid form when stored prior to being used in imaging operations. Solid ink or phase change inks typically have a solid form, either as pellets or as ink sticks of colored cyan, yellow, magenta and black ink, that are inserted into feed channels in a printer through openings to the channels. After the ink sticks are fed into the printer, they are urged by gravity or a mechanical actuator to a heater assembly of the printer. The heater assembly includes a heater and a melt plate. The heater, which converts electrical energy into heat, is positioned proximate the melt plate to heat the melt plate to a temperature that melts an ink stick coming into contact with the melt plate. The melt plate may be oriented to drip melted ink into a reservoir and the ink stored in the reservoir continues to be heated while awaiting subsequent use.

Each reservoir of colored, liquid ink may be fluidly coupled to an inkjet printing apparatus through at least one fluid pathway. The liquid ink is supplied from the reservoir as the inkjet ejectors emit ink onto a receiving medium or imaging member. The inkjet ejectors in the inkjet printing apparatus may be piezoelectric devices that eject the ink onto an imaging surface. The inkjet ejectors are selectively activated by a controller with a driving signal.

Conduits typically employed in transporting ink between a reservoir and one or more inkjet ejectors may be referred to as "umbilicals". An umbilical is a flexible conduit fluidly coupled to an inkjet printing apparatus at one end and one or more ink supplies at another end. An umbilical may contain one or many separate channels for transporting fluids such as ink. Typical prior art umbilical assemblies include one or more conduits formed from a flexible material, such as extruded silicone, for example. During operation, the delivery conduits are filled with ink so as to avoid inserting air bubbles into the inkjet ejectors. Air bubbles suspended in ink supplying the jet stack may cause ejector misfires during imaging operations.

During maintenance and cleaning operations, ink within an ink reservoir may be occasionally purged through the inkjet ejectors to restore a clear path through one or more inkjet ejectors. An ink receptacle may be used to capture and hold the purged ink. The purged ink in the receptacle is currently discarded, however, an ink transfer system that can reclaim ink purged from an inkjet printing apparatus would be beneficial.

SUMMARY

An improved liquid ink delivery system has been developed. The system includes an inkjet printing apparatus having a plurality of inkjet ejectors, each inkjet ejector configured to purge ink from an aperture formed in each inkjet ejector, an ink receptacle having an inlet positioned proximate to the plurality of inkjet ejectors to receive ink purged through the plurality of inkjet ejectors, a second ink container having an outlet, a first conduit that fluidly connects the outlet to the ink receptacle, a pump operatively connected to the first conduit to enable the pump to move fluid from within the ink receptacle through the first conduit to the outlet, a porous member positioned within the ink receptacle between the inlet and the pump, and a flow restrictor operatively connected to the first conduit at a first position between the porous member and the pump and to the second ink container. The porous member is configured to enable ink to pass through the porous member at a first pressure and to enable air to pass through the porous member at a second pressure that is greater in magnitude than the first pressure. The flow restrictor is configured to enable ink flow from the outlet to the first position in the first conduit through a second fluid flow path to the first conduit to establish a pressure at the porous member that is between the first pressure and the second pressure to prevent the pump from moving air through the filter.

An improved fluid transfer system has been developed. The system includes an inlet, an outlet operatively connected to the inlet to form a flow path from the inlet to the outlet, a pump operatively connected within the flow path to enable the pump to move fluid from the inlet to the outlet along the flow path, a porous member disposed between the inlet and the pump, and a flow restrictor operatively connected to the flow path at a first position between the porous member and the pump and to the flow path at a second position to the outlet. The porous member is configured to enable fluid to pass through the porous member at a first pressure and to enable air to pass through the porous member at a second pressure that is greater in magnitude than the first pressure. The flow restrictor is configured to enable flow from the outlet to the first position in the flow path to establish a pressure at the porous member that is between the first pressure and the second pressure to prevent the pump from moving air through the filter.

DETAILED DESCRIPTION

Figure 1:
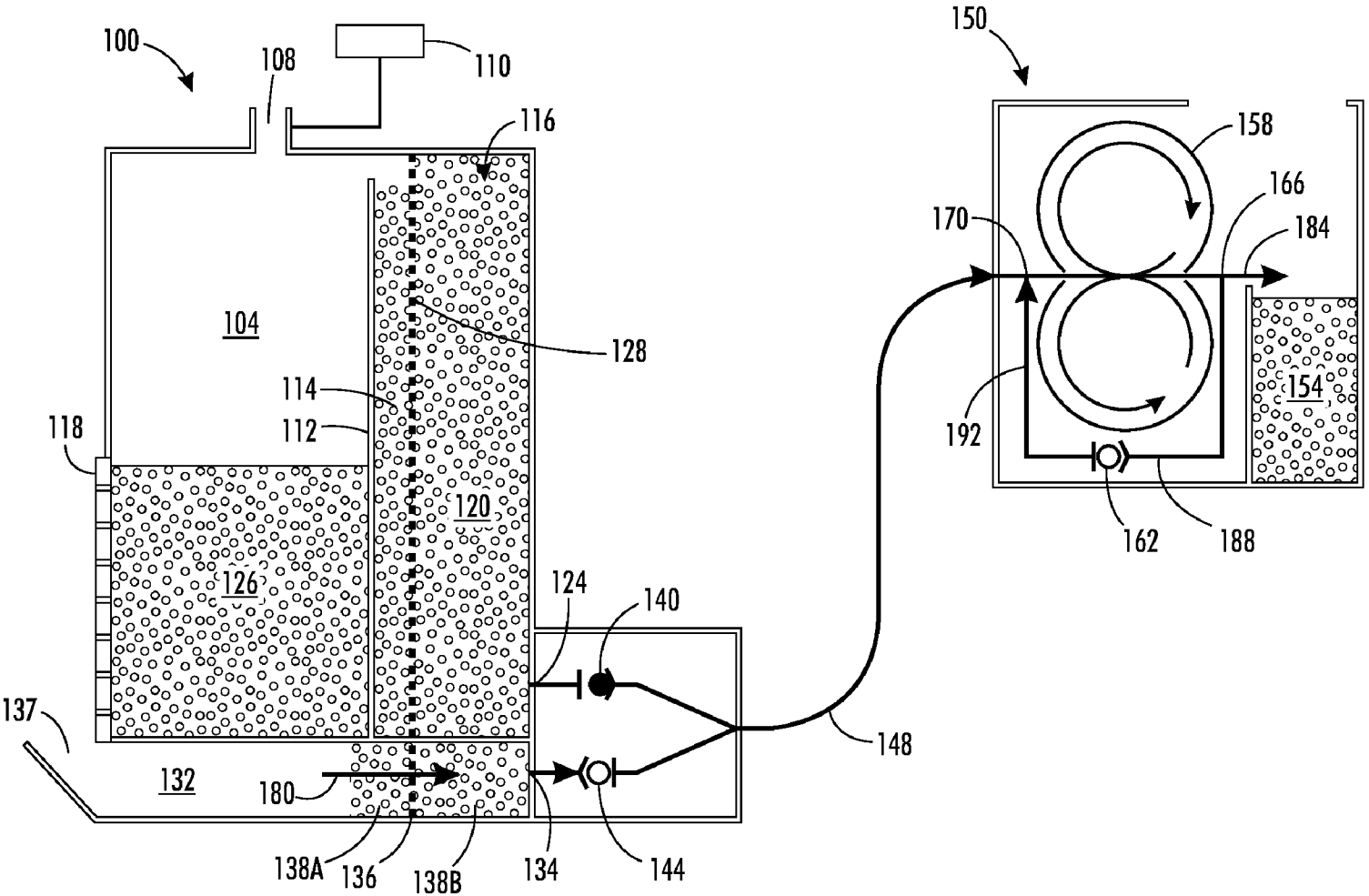
FIG. 1 is a schematic view of an inkjet printing apparatus operatively connected to an external ink supply including a reversible pump fluidly coupled to a flow restrictor.

For a general understanding of the environment for the system and method disclosed herein as well as the details for the system and method, reference is made to the drawings. In the drawings, like reference numerals have been used throughout to designate like elements. The term "meniscus" refers to an attraction of a liquid, such as ink, to a material surrounding an opening in a material, such as a pore in a membrane positioned across a path for the liquid. The meniscus holds the liquid in the pore until a higher pressure is reached that breaks the liquid attraction to the membrane material and pulls gas through the pore. Consequently, a membrane having wetted pores enables liquids to be pulled through the pores of the membrane while preventing a gas from passing through the membrane as long as the pressure across the wetted pores remains below the pressure that breaks the meniscus. The term "weir" refers to a wall positioned within a chamber that is as wide as the chamber, but not as tall as the chamber. Thus, liquid builds behind the weir until it reaches the top of the weir and then overflows into the chamber. In this manner, the liquid level on the two sides of the weir may be maintained at different heights. The term "conduit" refers to a body having a passageway or lumen through it for the transport of a liquid or a gas. As used herein, "purging ink" refers to any emission of ink from an inkjet ejector that does not land on an image receiving member whether deliberate or accidental. Purged ink refers to ink emitted from the ejector during purging.

Referring to FIG. 1, a liquid ink delivery system is shown. The system includes an inkjet printing apparatus 100 that is operatively coupled to an external ink supply 150 via a conduit 148. External ink supply 150 is configured to pump ink through conduit 148 into inkjet printing apparatus 100 in a forward direction, and to withdraw ink through conduit 148 from inkjet printing apparatus 100 in a reverse direction.

Inkjet printing apparatus 100 includes an ink inlet port 124, a plurality of inkjet ejectors 118, a vent 108, and an ink receptacle 132 mounted to the inkjet printing apparatus 100. Disposed within the inkjet printing apparatus 100 are a weir 112 and a reservoir filter 128. The weir 112 divides the internal space of the inkjet printing apparatus 100 into a manifold chamber 104 and an ink inlet chamber 116. Ink 120 enters the ink inlet chamber 116 through port 124. The inlet ink 120 passes through the pores of the filter 128, overflows weir 112, and enters manifold 104 as manifold ink 126. Manifold 104 holds ink 126 until the action of diaphragms in the inkjet ejectors 118 produce negative pressure that pulls ink 126 from the manifold 104 into the inkjet ejectors 118 and then ejects the ink through apertures in the inkjet ejectors 118. Inkjet ejectors 118 are shown in direct fluid communication with manifold 104 in FIG. 1, but in various alternative embodiments the ejectors can be somewhat distant from the manifold 104 and may be coupled to an ink supply through various conduits and intermediate chambers. The ejectors 118 are formed with an inkjet ejector stack as is well known in the art. Ink purged through the inkjet ejectors 118 drips into an inlet 137 in the ink receptacle 132.

In the embodiment of FIG. 1, reservoir filter 128 may be a membrane that includes a plurality of pores with each pore being approximately 10 μm in size, although other pore sizes may be used depending upon the pressures produced within the inkjet printing apparatus 100 and the properties of the ink. A suitable material for reservoir filter 128 is a stainless steel mesh filter, although other porous membranes may be used. The reservoir filter 128 extends across the entire width and height of the ink inlet chamber 116. Reservoir filter 128 prevents contaminants in ink 120 from entering the manifold 104, and as ink wets the side of reservoir filter 128 proximate to port 124, an ink meniscus forms on the pores in printhead filter 128, resisting a flow of air from manifold 104 into inlet ink 120. Inlet ink 120 passes through reservoir filter 128, collecting behind weir 112, which extends upwardly between ink inlet chamber 116 and manifold 104. Ink volume 114 collects between weir 112 and reservoir filter 128. Weir 112 maintains ink 114 at a higher level than the ink 126 held in manifold 104.

Vent 108 is opened to connect the manifold 104 of the inkjet printing apparatus 100 to atmospheric pressure during imaging operations. This operation enables an outside gas, such as air, to enter the manifold 104 while ink drops are ejected from inkjet ejectors 118. To connect the internal space of the inkjet printing apparatus 100 to the atmosphere selectively, an actuator 110, such as a solenoid, is positioned at an opening of vent 108. In FIG. 1, vent 108 is opened. During purging operations, actuator 110 may close vent 108 to facilitate purging ink from manifold 104 into ink receptacle 132.

As noted above, ink receptacle 132 is positioned to collect ink purged through inkjet ejectors 118. The ink receptacle 132 extends from receptacle inlet 137 to an ink receptacle port 134. Receptacle 132 includes a receptacle filter 136, which may be a membrane placed between receptacle inlet 137 and port 134. The receptacle filter 136 may be formed from the same metallic mesh as reservoir filter 128, or may include pores of a larger or smaller size than are formed in the reservoir filter 128. Additionally, other porous membranes may be used for the receptacle filter 136.

Port 124 of ink inlet chamber 116 and port 134 of ink receptacle 132 are each placed in fluid communication with a single conduit 148 via check valves 140 and 144, respectively. Check valve 140 is configured to allow ink supplied under positive pressure to enter ink inlet chamber 116 via port 124. Check valve 140 is biased closed when an insufficient level of positive pressure, including a level of negative pressure, is applied through conduit 148. In the embodiment of FIG. 1, check valve 140 is an optional feature which may be removed to allow the ink inlet chamber 116 to remain in fluid communication with ink conduit 148 when negative pressure is applied to conduit 148. Check valve 144 is configured to allow negative pressure applied via conduit 148 to withdraw ink held in receptacle 132. Check valve 144 is biased closed when an insufficient level of negative pressure, including a level of positive pressure, is applied through conduit 148. Thus, check valves 140 and 144 are configured so that at most one of the check valves 140 and 144 is open at a given time during operation of inkjet printing apparatus 100. In the configuration of FIG. 1, negative pressure is applied to conduit 148, allowing check valve 144 to open and place receptacle 132 in fluid communication with conduit 148, while check valve 140 is closed and ink inlet chamber 116 is not in fluid communication with ink inlet 148.

One suitable embodiment of a check valve is a ball valve including a seat with an opening and a ball having a diameter greater than a diameter of the opening. Gravity or a mechanism such as a spring biases the ball into the seat, closing the valve. Alternative check valve embodiments may employ needles, cylinders, flappers, duckbills or the like to permit fluid to flow in a single direction. The valve opens when pressure applied through the opening in the seat pushes the ball from the seat, allowing fluid to flow in one direction.

Ink supply 150 is fluidly coupled to inkjet printing apparatus 100 via conduit 148. Ink supply 150 includes an ink reservoir 154, a reversible pump 158, and a flow restrictor 162. The ink reservoir 154 holds a supply of liquid ink. Various types of liquid ink may be used including aqueous ink supplied by an ink cartridge or the like, or phase change ink that is liquefied on a melt plate and drip into ink reservoir 154. Other forms of liquid ink including both curable and non-curable ink, as well as magnetic ink may be held in reservoir 154. Pump 158 is a reversible pump configured to supply positive and negative pressure to conduit 148. In the embodiment of FIG. 1, pump 158 is a gear pump including two counter-rotating gears, described in more detail below.

Flow restrictor 162 is configured to limit the rate of flow of fluid through pump 158 in direction 184, and consequently flow restrictor 162 limits the level of negative pressure applied by pump 158 to conduit 148. The example flow restrictor 162 of FIG. 1 includes a one-way bypass relief valve fluidly connected to an inlet bypass path 188 and an outlet bypass path 192. The structure of the one-way valve is described in further detail below. The inlet bypass path 188 is fluidly connected to the outlet 166 of ink reservoir 154 between the reservoir 154 and the pump 158. The outlet bypass path 192 is fluidly connected to the fluid path between receptacle filter 136 of the receptacle 132 and the pump 158, with the specific embodiment of outlet path 192 connecting with the fluid path at location 170 between the conduit 148 and pump 158. The flow restrictor 162 is shown as a one-way valve, and in the embodiment of FIG. 1, the one-way valve closes when pump 158 applies positive pressure supplying ink to inkjet printing apparatus 100. Thus, the positive pressure level applied by pump 158 when supplying ink to inkjet printing apparatus 100 is not altered by flow restrictor 162.

In a reverse operating mode seen in FIG. 1, pump 158 applies negative pressure to withdraw ink from the ink receptacle 132 of inkjet printing apparatus 100 via conduit 148. The negative pressure applied through conduit 148 is sufficient to open check valve 144, and to withdrawn ink 138A and 138B from the ink receptacle in direction 180 through conduit 148 and through pump 158 in direction 184 into ink reservoir 154. Ink is withdrawn from the ink receptacle 132 until a volume of ink corresponding to ink 138A is removed, and receptacle filter 136 is exposed to air. Ink 138B remaining in receptacle 132 wets the side of receptacle filter 136 proximate to the port 134. A fluid ink meniscus forms across pores in the membrane of receptacle filter 136, with the meniscus requiring a pressure level greater than the negative pressure applied through conduit 148 to draw air through the receptacle filter 136. The pressure required for withdrawing ink 138B increases accordingly, and the flow of ink ceases once the receptacle filter 136 is exposed to air. Thus, the negative pressure applied by ink supply 150 is sufficient to withdraw ink held in the ink receptacle 132, but is below a pressure level that draws air through the receptacle filter 136. In embodiments of inkjet printing apparatus 100 that omit check valve 140, the meniscus strength present on reservoir filter 128 similarly prevents air from crossing reservoir filter 128 and forming bubbles in inlet ink 120.

Flow restrictor 162 regulates the negative pressure applied by pump 158 to produce the appropriate level of negative pressure described above. In the example embodiment of FIG. 1, a negative pressure of 0.2 psi is sufficient to open check valve 144 and to begin withdrawing ink from receptacle 132, while the meniscus formed on receptacle 136 prevents air from passing through the filter below pressures of 0.6 psi. Thus, flow restrictor 162 and pump 158 are configured to limit the negative pressure applied to be between 0.2 psi and 0.6 psi, with 0.4 psi being one appropriate negative pressure limit.

Flow restrictor 162 limits the effective amount of negative pressure applied by pump 158 to conduit 148 by providing an additional flow path to the one through the conduit 148. A portion of the ink withdrawn by the pump 158 is re-circulated through this path. As negative pressure is applied, a portion of the ink flowing in direction 184 is diverted prior to entering ink reservoir 154 through inlet path 188, flow restrictor 162, and through outlet path 192, to be pumped through pump 158 again. The effective negative pressure applied to ink withdrawn through conduit 148 decreases as more ink from flow restrictor 162 is recirculated through pump 158. The proportion of ink diverted in this manner is determined, at least in part, by the diameters of inlet path 188 and outlet path 192, and by the fluid resistance of flow restrictor 162, described in more detail below. The proportion is also influenced by the flow rate of ink traveling in direction 184, with no ink being diverted when flow restrictor 162 remains closed. If the flow of ink in direction 184 produces a negative pressure sufficient to open flow restrictor 162, the proportion of ink diverted through flow restrictor 162 increases in response to an increase in the flow rate through pump 158.

Flow restrictor 162 may limit the negative pressure applied by pump 158 over a range of pressures the pump 158 could apply in the absence of a pressure regulator, since the amount of ink diverted to flow restrictor 162 increases as the flow rate of pump 158 increases. For example, depending upon manufacturing tolerances, rotational speed, and environmental conditions, pump 158 may operate with negative pressures between 0.6 psi and 0.9 psi. The negative pressure level may vary over time as well. An example embodiment of flow restrictor 162 may be configured to accommodate the range of pump pressures to limit the effective negative pressure applied to conduit 148 to 0.4 psi. When pump 158 has a negative pressure level that would otherwise produce a negative pressure level near 0.6 psi, a first quantity of ink is diverted through flow restrictor 162, and pump 158 pumps the diverted ink one or more extra times, lowering the magnitude of pressure seen by conduit 148 to the 0.4 psi limit. If pump 158 operates with a pressure that would otherwise be at or near the 0.9 psi level, the amount of ink passing through flow restrictor 162 increases, pump 158 recirculates a relatively greater amount of ink, and the pressure seen by conduit 148 remains at 0.4 psi. The pump and flow restrictor may be configured to operate over a range of pressures other than those described above.

Figure 2:
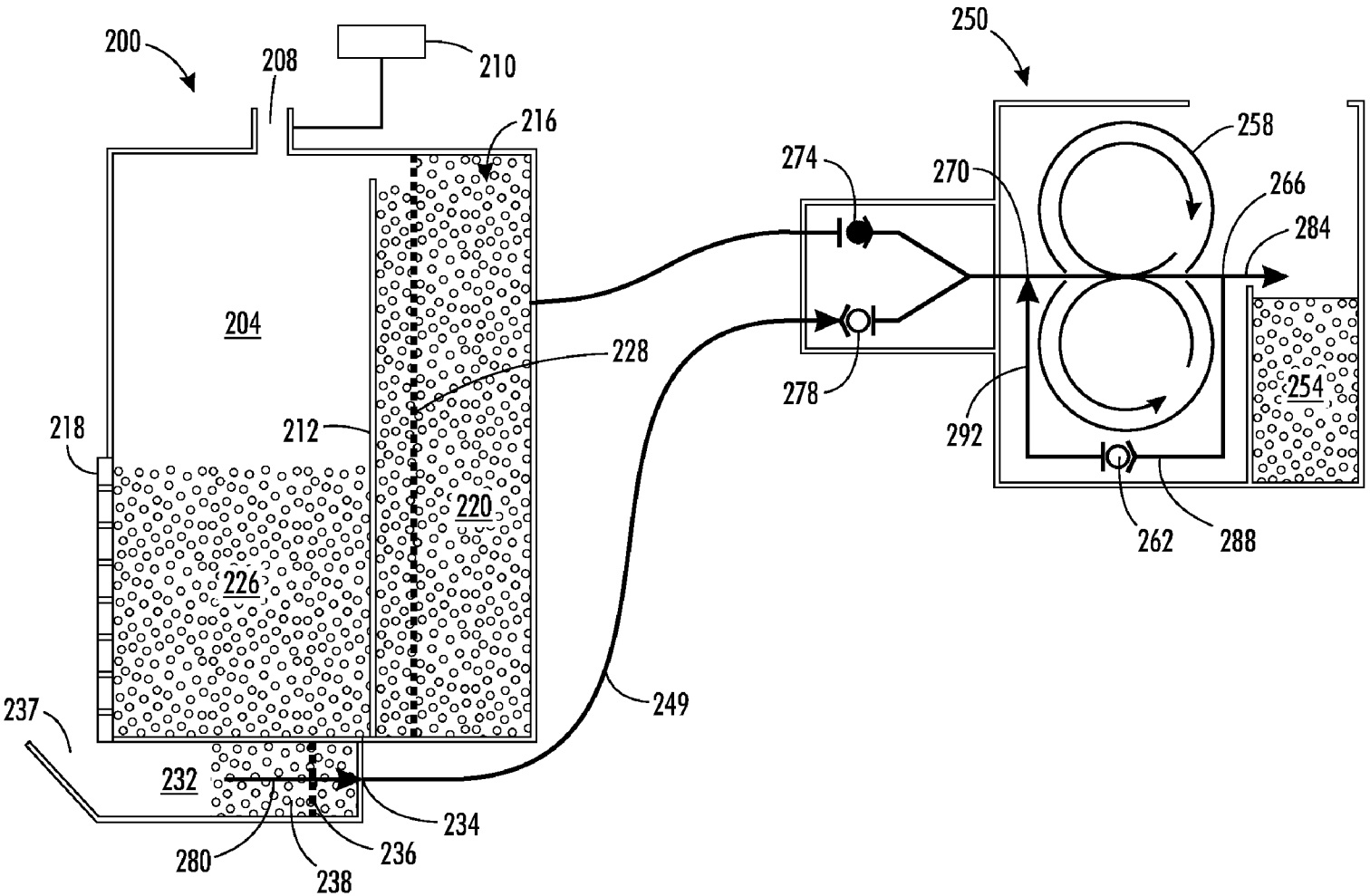
FIG. 2 is a schematic view of an alternative inkjet printing apparatus operatively connected to an external ink supply including a reversible pump fluidly coupled to a flow restrictor.

FIG. 2 depicts an alternative inkjet printing apparatus 200 and ink supply 250 with operating principle similar to those shown in FIG. 1. Inkjet printing apparatus 200 shares some features with inkjet printing apparatus 100 including a vent 208 operably connected to an actuator 210, and a weir 212 that separates an ink inlet chamber 216 from an ink manifold 204 that holds ink 226 for ejection through inkjet ejectors 218. Inkjet printing apparatus 200 also includes a reservoir filter 228 located between weir 212 and a port 224, with ink 220 passing through filter 228 and overflowing weir 212 to supply manifold ink 226. Ink 226 may be purged through the ejectors 218 where it drips into an inlet 237 of an ink receptacle 232 attached to the inkjet printing apparatus 200. Ink in the ink receptacle 232 may be withdrawn through a port 234.

In the embodiment of FIG. 2, conduits 248 and 249 are coupled to ink inlet chamber port 224 and ink receptacle port 234, respectively. Instead of placing check valves within the inkjet printing apparatus as shown in FIG. 1, check valves 274 and 278 are placed in ink supply 250. Check valve 274 is configured to remain closed when insufficient positive pressure is applied by pump 258, and check valve 278 is configured to remain closed when insufficient negative pressure is applied by pump 258. As described above in reference to check valve 140 of FIG. 1, check valve 274 may be omitted from alternative embodiments of ink supply 250.

In a reverse mode of operation, pump 258 withdraws purged ink 238A and 238B from ink receptacle 232 in direction 280, through conduit 249, and pumps the ink in direction 284 into ink supply 254 through ink outlet 266. The level of negative pressure applied by pump 258 is sufficient to open check valve 278 and withdraw ink from the ink receptacle 232. The magnitude of the negative pressure level is also small enough that when a receptacle filter 236 is exposed to air, negative pressure required to pull air through the receptacle filter 236 is greater than the negative pressure applied to the ink receptacle port 234. A bypass fluid path including inlet path 288 and outlet path 292 re-circulates a portion of ink passing through the pump from ink outlet 266 to location 270 through flow restrictor 262 if flow restrictor 262 is opened. The recirculation regulates the level of negative pressure applied by pump 258 to conduit 249. Flow restrictor 262 limits the effective negative pressure applied by pump 258 as described with reference to FIG. 1.

Figure 3:
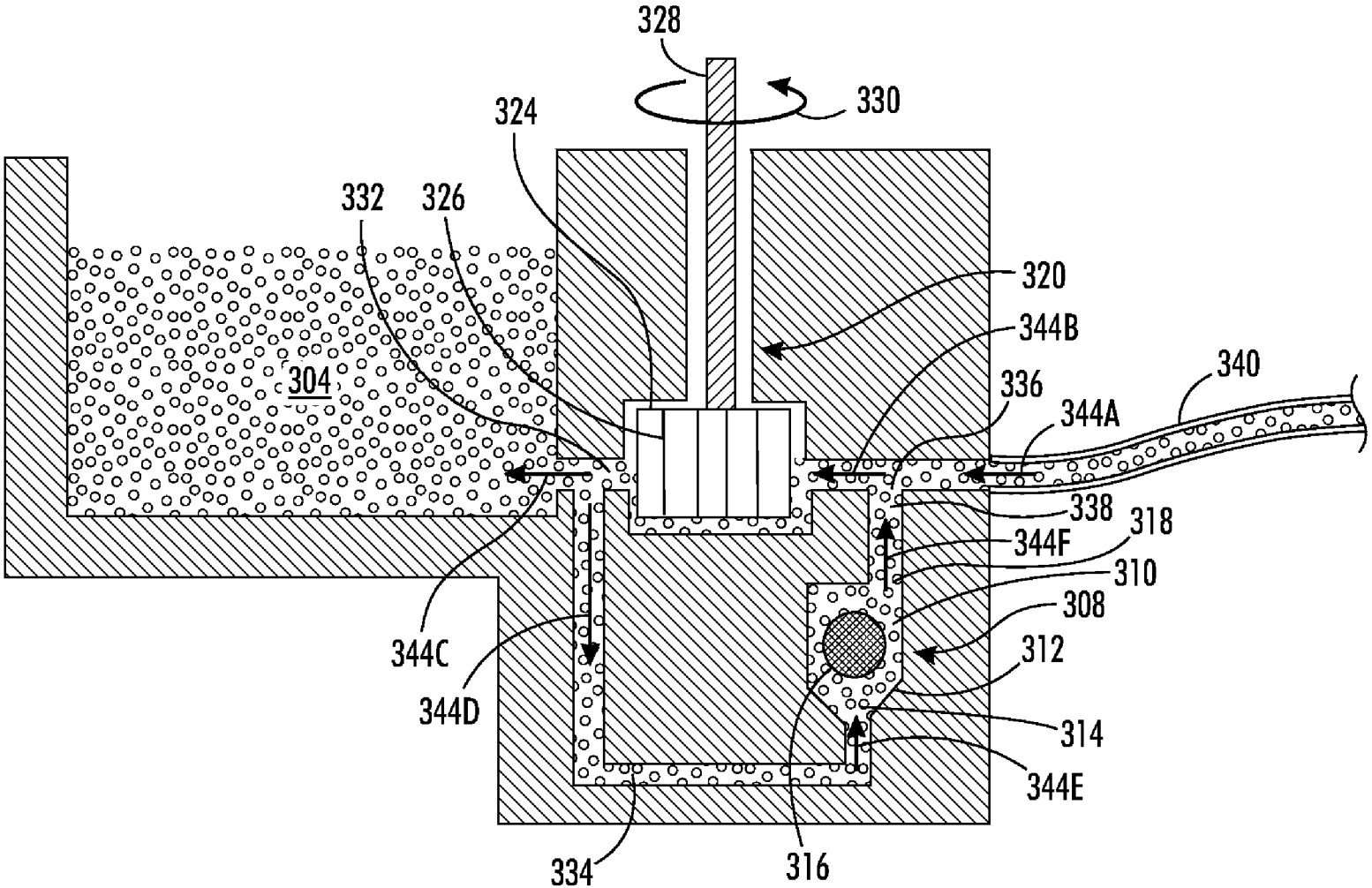
FIG. 3 is a cut-away side view of one embodiment of an external ink supply including a flow restrictor.

A depiction of an ink reservoir 304, reversible pump 320, and flow restrictor 308 which may be adapted for use with the embodiments of FIG. 1 and FIG. 2 is shown in FIG. 3. Ink reservoir 304 is fluidly coupled to gear pump 320, flow restrictor 308, and a conduit 340. Gear pump 320 includes a drive axle 328 configured to rotate a gear 324 including a plurality of teeth 326. Drive axle 328 may be rotated by a motor such as an electric motor, either directly or through a transmission such as a drive belt or the like. A second drive axle and gear assembly is arranged with teeth of the second gear meshing with teeth 326, and the two drive axle and gear assemblies rotate in opposite directions. In the configuration of FIG. 3, drive axle 328 and gear 324 rotate as shown in direction 330, applying negative pressure to ink in conduit 340. Gear pump 320 may also rotate gear 324 in the reverse direction of FIG. 3, applying positive pressure to pump ink out of reservoir 304.

Ink flow restrictor 308 is comprised of a one-way valve having a ball 316 and a seat 312 configured to hold the ball when the valve is closed. As shown in FIG. 3, ink enters flow restrictor 308 in direction 344E through a valve inlet 314, flows through a valve body 310, and exits in direction 344F through a valve outlet 318. Ball 316 is biased into seat 312 by gravity, and a threshold pressure applied by ink flowing in direction 344E is needed to unseat ball 316 and open one-way valve 308. The amount of pressure needed to open the valve 308 is determined, at least in part, by the mass of ball 316, diameter of inlet 314, and geometry of seat 312. In the embodiment of flow restrictor 308, the pressure needed to displace ball 316 from seat 312 increases as the mass of ball 316 increases and as the angle between the sides of seat 312 becomes more shallow.

In FIG. 3, pump 320 applies negative pressure to conduit 340, producing a flow of ink indicated by arrows 344A-344D. In FIG. 3, the negative pressure is sufficient to allow ink to flow through flow restrictor 308. A portion of ink exits pump 320 in direction 344C, entering reservoir 304, and a remaining portion of the ink enters an inlet bypass path 334 in direction 344D where the ink subsequently flows through valve inlet 312 in direction 344E. Ink passes through the valve body 310 around ball 316 and through an outlet 318 of flow restrictor 308. Ink travels through an outlet bypass path 338 that is placed in fluid communication with conduit 340 at location 336, prior to ink from conduit 340 entering pump 320. A flow restrictor configuration similar to that of FIG. 3 may be referred to as a one-way bypass valve since ink bypasses the direct fluid path from pump 320 to ink reservoir 304, and is recirculated through pump 320.

As pump 320 pumps a proportion of ink withdrawn through conduit 340 multiple times, the effective negative pressure on ink entering from ink conduit 340 is limited. The configuration of flow restrictor 308 is selected to limit the level of negative pressure that pump 320 generates through conduit 340, without directly adjusting the rotational rate of gear 324 in pump 320. Pump 320 may be operated with a single rotational speed, and the volume of ink recirculating through the flow restrictor 308 and pump 320 limits the effective pressure applied to conduit 340 over a range of flow rates generated by pump 320.

Figure 4:
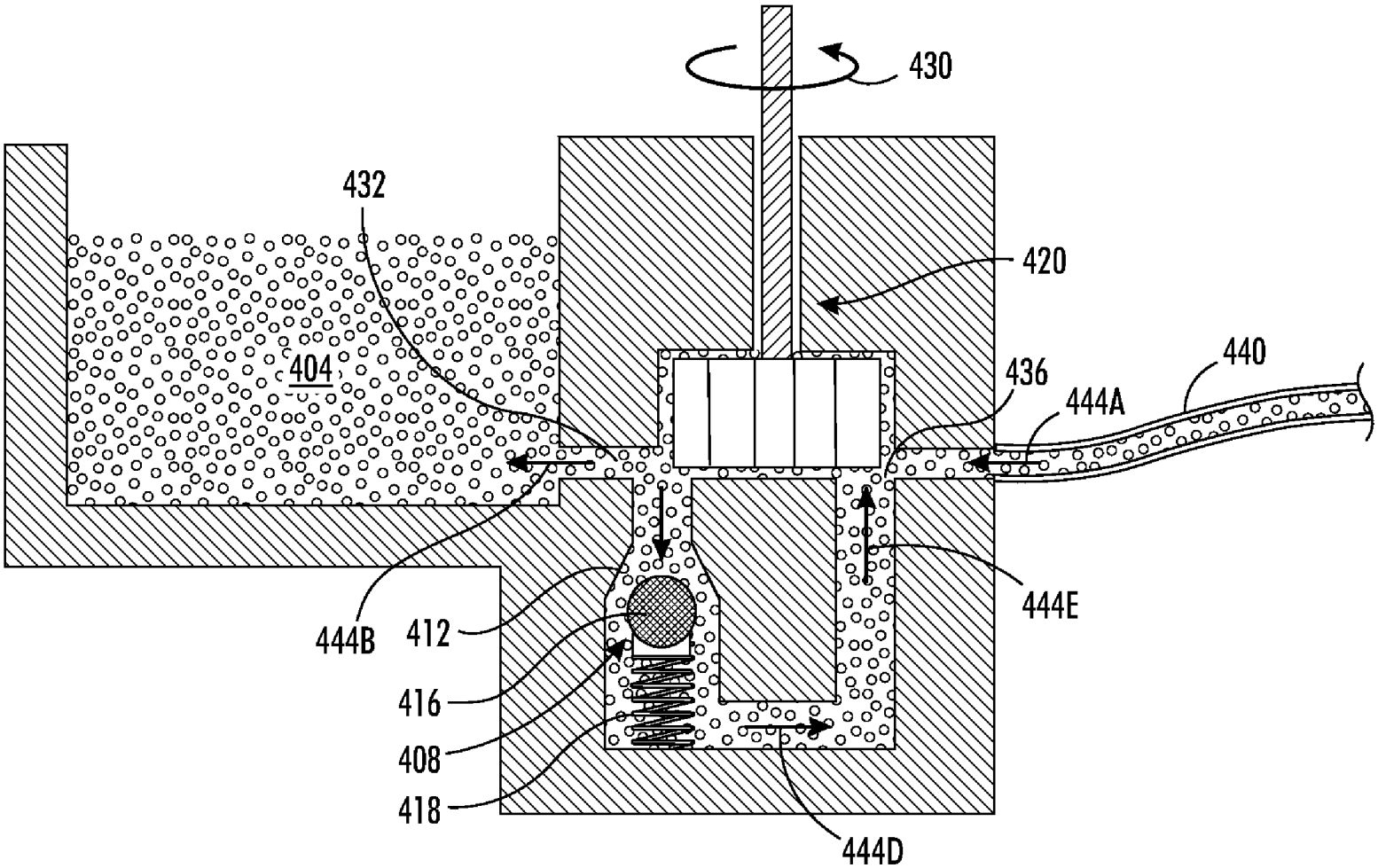
FIG. 4 is a cut-away side view of another embodiment of an external ink supply including a flow restrictor.

FIG. 4 depicts an alternative configuration for a pump 420, flow restrictor 408, and ink reservoir 404. Gear pump 420 is similar to the gear pump 320 of FIG. 3, and gear pump 420 rotates in direction 430 to generate negative pressure and withdrawing ink from conduit 440 as shown by arrows 444A-444E. In FIG. 4, flow restrictor 408 includes a spring 418 configured to bias ball 416 into seat 412. To overcome the biasing force, recirculating ink flows from location 432 in direction 444C, displacing ball 416 from seat 412 in direction 444C. Ink travels in direction 444D and 444E, joining ink supplied through conduit 440 at location 436 prior to entering pump 420.

As with the flow restrictor 308 of FIG. 3, flow restrictor 408 is configured to limit the negative pressure that pump 420 may apply to conduit 440 by recirculating ink through pump 440. In the case of flow restrictor 408, the spring coefficient of spring 418 and the mass of ball 416 determine, at least in part, the proportion of ink leaving pump 420 that is recirculated. As the flow rate of ink passing through pump 420 increases, the flow rate of ink entering flow restrictor 408 in direction 444C increases, limiting the level of negative pressure applied to conduit 440. Spring 418 biases ball 416 into seat 412 when pump 420 operates in a forward direction and when a negative flow rate through pump 420 is below a flow rate needed to open flow restrictor 408.

Figure 5:
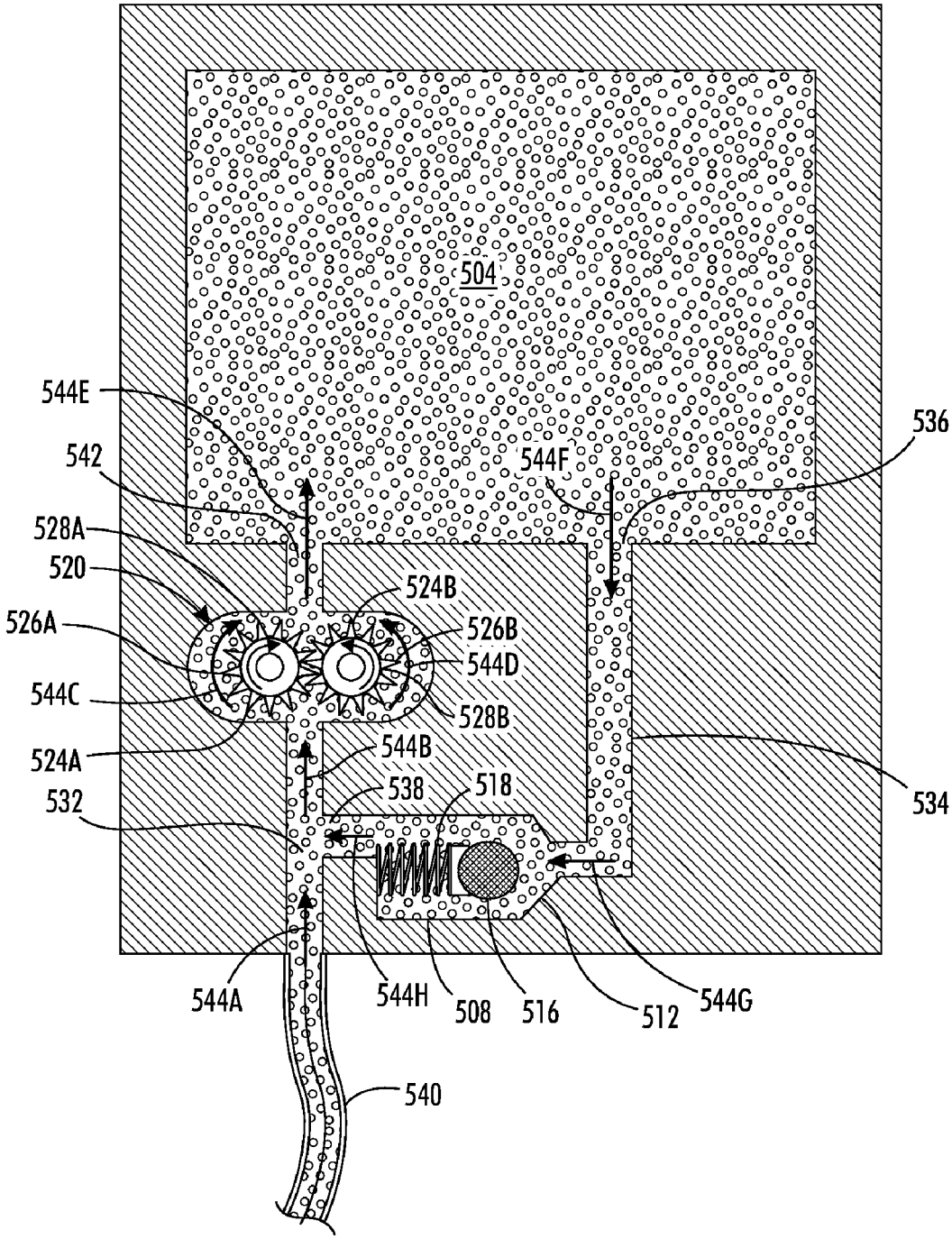
FIG. 5. is a cut-away top view of yet another embodiment of an external ink supply including a flow restrictor.

Referring to FIG. 5, a top-view of an ink reservoir 504, flow restrictor 508, and pump 520 is shown. FIG. 5 shows gear pump 520 with two gears 524A and 524B each having a plurality of teeth 526A and 526B, respectively. Gears 524A and 524B are positioned to mesh teeth 526A and 526B together while rotating. Gears 524A and 524B in pump 520 rotate in directions 528A and 528B, respectively, and the movement of teeth 526A and 526B forms a negative pressure on conduit 540. Ink flows from conduit 540 into reservoir 504 through outlet 542. As shown by arrows 544C and 544D, ink flows around the outer diameter of gears 524A and 524B towards reservoir 504. A portion of the ink bypasses through flow restrictor 508 in the event that flow restrictor 508 is opened. The flow of ink through conduit 540, pump 520, and flow restrictor 508 is shown by arrows 544A-544H.

In FIG. 5, flow restrictor 508 includes ball 516 configured to be biased shut by spring 516 into seat 512 in a similar manner to flow restrictor 408 of FIG. 4. Flow restrictor 508 is placed in fluid communication with the conduit 540 at location 532 via outlet bypass path 538, and is placed in fluid communication with reservoir at location 536 via inlet bypass path 534. In the embodiment of FIG. 5, as ink flows into reservoir 504 in direction 544E, some ink may be diverted from reservoir 504 into flow restrictor 508 in directions 544F and 544G. Flow restrictor 508 remains in fluid communication with outlet 542 via reservoir 504. If there is sufficient pressure to open flow restrictor 508, bypassed ink leaves flow restrictor 508 in direction 544H where the ink is recirculated through pump 520. Flow restrictor 508, inlet bypass path 534 and outlet bypass path 538 are shown in FIG. 5 with a horizontal orientation, and various embodiments may route ink through both vertical and horizontal paths.

It will be appreciated that variants of the above-disclosed and other features and functions, or alternatives thereof, may be desirably combined into many other different systems, applications or methods. For example, while the flow restrictor embodiments described above are configured to limit negative pressure applied while withdrawing ink, the foregoing embodiments could be modified to employ flow restrictors to limit positive pressure used to supply ink as well. Additionally, alternative one-way valve embodiments and flow restrictor configurations may be modified for use with the foregoing ink supplies. Various presently unforeseen or unanticipated alternatives, modifications, variations or improvements therein may be subsequently made by those skilled in the art which are also intended to be encompassed by the following claims.

What is claimed is:

1. A liquid ink delivery system comprising:

an inkjet printing apparatus having an ink reservoir and a plurality of inkjet ejectors, the inkjet printing apparatus being configured to purge ink from the ink reservoir through the inkjet ejectors;

an ink receptacle having an inlet positioned proximate the inkjet printing apparatus to receive ink purged through the plurality of inkjet ejectors;

a second ink reservoir having an outlet;

a first conduit having a first end and a second end, the first end of the first conduit being fluidly connected to the ink receptacle;

a second conduit having a first and a second end, the first end of the second conduit being fluidly connected to the ink reservoir of the inkjet printing apparatus;

a bi-directional pump operatively connected to the second end of the first conduit, the second end of the second conduit, and the outlet of the second ink reservoir;

a first one-way valve fluidly connected between the pump and the first end of the first conduit;

a second one-way valve fluidly connected between the pump and the first end of the second conduit, the first and the second one-way valves enabling the pump to move purged ink from within the ink receptacle through the first conduit to the outlet of the second ink reservoir in response to the pump operating in a first direction and to move ink from the second ink reservoir through the outlet and the second conduit to the ink reservoir in the inkjet printing apparatus in response to the pump operating in a second direction;

a porous member positioned within the ink receptacle between the inlet and the first one-way valve, the porous member being configured to enable ink to pass through the porous member at a first negative pressure and to enable air to pass through the porous member at a second negative pressure that is greater in magnitude than the first negative pressure; and a flow restrictor having a first end and a second end, the first end of the flow restrictor being operatively connected between the first one-way valve and the pump and the second end of the flow restrictor being operatively connected between the pump and the second ink reservoir, the flow restrictor being configured to enable ink to flow from the second ink reservoir to a position between the first one-way valve and the pump through a second fluid flow path to establish a negative pressure at the porous member that is between the first pressure and the second pressure to prevent the pump from moving air through the porous member in response to the pump operating in the first direction.

2. The system of claim 1 wherein the flow restrictor is a third one-way valve in the second fluid flow path that is configured to enable ink to flow from the second ink reservoir through the third one-way valve to the position between the first one-way valve and the pump in response to the negative pressure at the porous member being at the established negative pressure and being configured to block fluid flow from the position between the first one-way valve and the pump to the second ink reservoir through the second fluid flow path and the third one-way valve in response to negative pressure at the porous member being lesser in magnitude than the established negative pressure.

3. The system of claim 2, the third one-way valve further comprising:

a stopping member that is biased to close the third one-way valve.

4. The system of claim 3, the third one-way value further comprising:

a biasing member that acts on the stopping member to close the third one-way valve.

5. The system of claim 4 wherein the biasing member is a spring.

6. The system of claim 3, the stopping member being biased by gravity.

7. The system of claim 3, the third one-way valve further comprising:

a seat in which the stopping member rests to close the third one-way valve, the seat having a diameter that corresponds to an ink flow that establishes the pressure at the porous member that is between the first pressure and the second pressure.

8. A liquid ink delivery system comprising:

a first ink reservoir configured to receive melted ink from a melting device;

an inkjet printing apparatus having a second ink reservoir and a plurality of inkjet ejectors, the inkjet printing apparatus being configured to purge ink from the second ink reservoir through the inkjet ejectors and the second ink reservoir being fluidly connected to the first ink reservoir through a first conduit;

an ink receptacle having an inlet positioned proximate the inkjet printing apparatus to receive ink purged through the plurality of inkjet ejectors, the ink receptacle being fluidly connected to the first ink reservoir through a second conduit;

a bi-directional pump operatively connected to the first conduit, the second conduit, and the first ink reservoir, the pump being configured to move ink from the first ink reservoir to the second ink reservoir through the first conduit in response to the pump being operated in a first direction and to move ink from the ink receptacle to the first ink reservoir through the second conduit in response to the pump being operated in a second direction;

a first one-way valve fluidly connected between the pump and the second conduit, the first one-way valve being configured to block ink from entering the second conduit in response to the pump operating in the first direction;

a second one-way valve fluidly connected between the pump and the first conduit, the second one-way valve being configured to block ink from exiting the first conduit in response to the pump operating in the second direction;

a porous member positioned within the ink receptacle between the inlet and the first one-way valve, the porous member being configured to enable ink to pass through the porous member at a first negative pressure and to enable air to pass through the porous member at a second negative pressure that is greater in magnitude than the first negative pressure; and a flow restrictor having a first end and a second end, the first end of the flow restrictor being operatively connected between the first one-way valve and the pump and the second end of the flow restrictor being operatively connected between the pump and the first ink reservoir, the flow restrictor being configured to enable ink to flow from the first ink reservoir to a position between the first one-way valve and the pump through a second fluid flow path to establish a negative pressure at the porous member that is between the first negative pressure and the second negative pressure to prevent the pump from moving air through the porous member.

9. The system of claim 8 wherein the flow restrictor is a third one-way valve in the second fluid flow path, the third one-way valve being configured to enable ink to flow from the first ink reservoir through the third one-way valve to the first one-way valve in response to the negative pressure at the porous member being at the established negative pressure and being configured to block fluid flow from the second conduit through the second fluid flow path to the first ink reservoir in response to negative pressure at the porous member being lesser in magnitude than the established negative pressure.

10. The system of claim 9, the third one-way valve further comprising:

a stopping member that is biased to close the third one-way valve.

11. The system of claim 10, the third one-way value further comprising:

a biasing member that acts on the stopping member to close the third one-way valve.

12. The system of claim 11 wherein the biasing member is a spring.

13. The system of claim 10, the stopping member being biased by gravity.

14. The system of claim 10, the third one-way valve further comprising:

a seat in which the stopping member rests to close the third one-way valve, the seat having a diameter that corresponds to an ink flow that establishes the pressure at the porous member that is between the first pressure and the second pressure.

* * * * *